US011137182B2

(12) United States Patent
Heschel et al.

(10) Patent No.: US 11,137,182 B2
(45) Date of Patent: Oct. 5, 2021

(54) THERMOSTATIC EXPANSION VALVES INCLUDING INTERCHANGEABLE METERING PINS

(71) Applicant: EMERSON ELECTRIC CO., St. Louis, MO (US)

(72) Inventors: Susan M. Heschel, Ballwin, MO (US); Kyle A. Strazar, Nokomis, IL (US); Christopher J. Schroeder, St. Charles, MO (US)

(73) Assignee: Emerson Electric Co., St. Louis, MO (US)

( * ) Notice: Subject to any disclaimer, the term of this patent is extended or adjusted under 35 U.S.C. 154(b) by 171 days.

(21) Appl. No.: 16/704,749

(22) Filed: Dec. 5, 2019

(65) Prior Publication Data

US 2021/0156599 A1 May 27, 2021

Related U.S. Application Data

(60) Provisional application No. 62/938,714, filed on Nov. 21, 2019.

(51) Int. Cl.
*F25B 41/31* (2021.01)

(52) U.S. Cl.
CPC ..... *F25B 41/31* (2021.01); *F25B 2600/2513* (2013.01)

(58) Field of Classification Search
CPC ..... F25B 41/31; F25B 2600/2513; F25B 41/335; F25B 2600/21
See application file for complete search history.

(56) References Cited

U.S. PATENT DOCUMENTS 2,550,022 A * 4/1951 Ray ..... F25B 41/31 236/92 B
2,966,044 A * 12/1960 Mitchell ..... B60H 1/3205 62/217
3,317,135 A * 5/1967 Feinberg ..... H01H 61/02 236/68 R
4,095,742 A 6/1978 Schumacher
4,341,090 A * 7/1982 Ramakrishnan ..... F25B 41/30 62/324.1
4,475,686 A * 10/1984 Huelle ..... F25B 41/31 236/68 C
4,523,436 A * 6/1985 Schedel ..... F25B 41/31 62/222
5,002,089 A * 3/1991 Reedy ..... F25B 41/30 137/493.8

(Continued)

*Primary Examiner* — Kun Kai Ma
(74) *Attorney, Agent, or Firm* — Harness, Dickey & Pierce, PLC; Anthony G. Fussner

(57) ABSTRACT

A thermostatic expansion valve includes an operating rod, a recessed receiver portion, and a first metering pin positioned at least partially within the receiver portion to selectively contact the operating rod. The first metering pin includes a base diameter, an overall length, and a taper portion. The taper portion is tapered at a specified degree relative to a longitudinal axis of the first metering pin. The thermostatic expansion valve is adapted to operate at a first specified refrigeration tonnage when the first metering pin is positioned at least partially within the receiver portion, and to operate at a second specified refrigeration tonnage when the first metering pin is replaced with a second metering pin including a different taper portion than the first metering pin.

20 Claims, 3 Drawing Sheets

(56) References Cited

U.S. PATENT DOCUMENTS

| | | | | |
|---|---|---|---|---|
| 5,026,022 | A * | 6/1991 | Bastle | F25B 41/31 251/122 |
| 5,832,744 | A * | 11/1998 | Dorste | F25B 39/028 62/528 |
| 6,161,766 | A * | 12/2000 | Goba | F25B 41/31 236/92 B |
| 7,707,844 | B2 | 5/2010 | Nestler et al. | |
| 9,631,850 | B2 * | 4/2017 | Liu | G05D 23/025 |
| 9,810,460 | B2 * | 11/2017 | Means | F25B 41/31 |
| 10,295,064 | B2 * | 5/2019 | Shu | F16K 1/385 |
| 2008/0087038 | A1 * | 4/2008 | Nicolaisen | F25B 9/008 62/498 |
| 2009/0045264 | A1 * | 2/2009 | Lou | F25B 41/31 236/92 B |
| 2016/0097465 | A1 * | 4/2016 | Sciuto | F16K 17/06 137/382 |
| 2017/0219277 | A1 * | 8/2017 | Ryu | F25B 49/025 |
| 2018/0142802 | A1 * | 5/2018 | Dickenscheid | F16K 1/36 |

* cited by examiner

1/2 TON

1/4 TON

1/5 TON

THERMOSTATIC EXPANSION VALVES INCLUDING INTERCHANGEABLE METERING PINS

CROSS-REFERENCE TO RELATED APPLICATION

This application claims the benefit and priority of U.S. Provisional Application No. 62/938,714, filed on Nov. 21, 2019. The entire disclosure of the above application is incorporated herein by reference.

FIELD

The present disclosure generally relates to thermostatic expansion valves including interchangeable metering pins.

BACKGROUND

This section provides background information related to the present disclosure which is not necessarily prior art.

A thermostatic expansion valve (TXV) is a commonly used device for controlling the flow of liquid refrigerant into an evaporator. Thermostatic expansion valves are often designed to regulate refrigerant liquid flow into an evaporator hi approximate proportion to evaporation of refrigerant liquid in the evaporator. Refrigerant gas leaving the evaporator is regulated by the thermostatic expansion valve responding to the temperature of the refrigerant gas leaving the evaporator and the pressure in the evaporator.

DRAWINGS

The drawings described herein are for illustrative purposes only of selected embodiments and not all possible implementations, and are not intended to limit the scope of the present disclosure.

DETAILED DESCRIPTION

Figure 1:
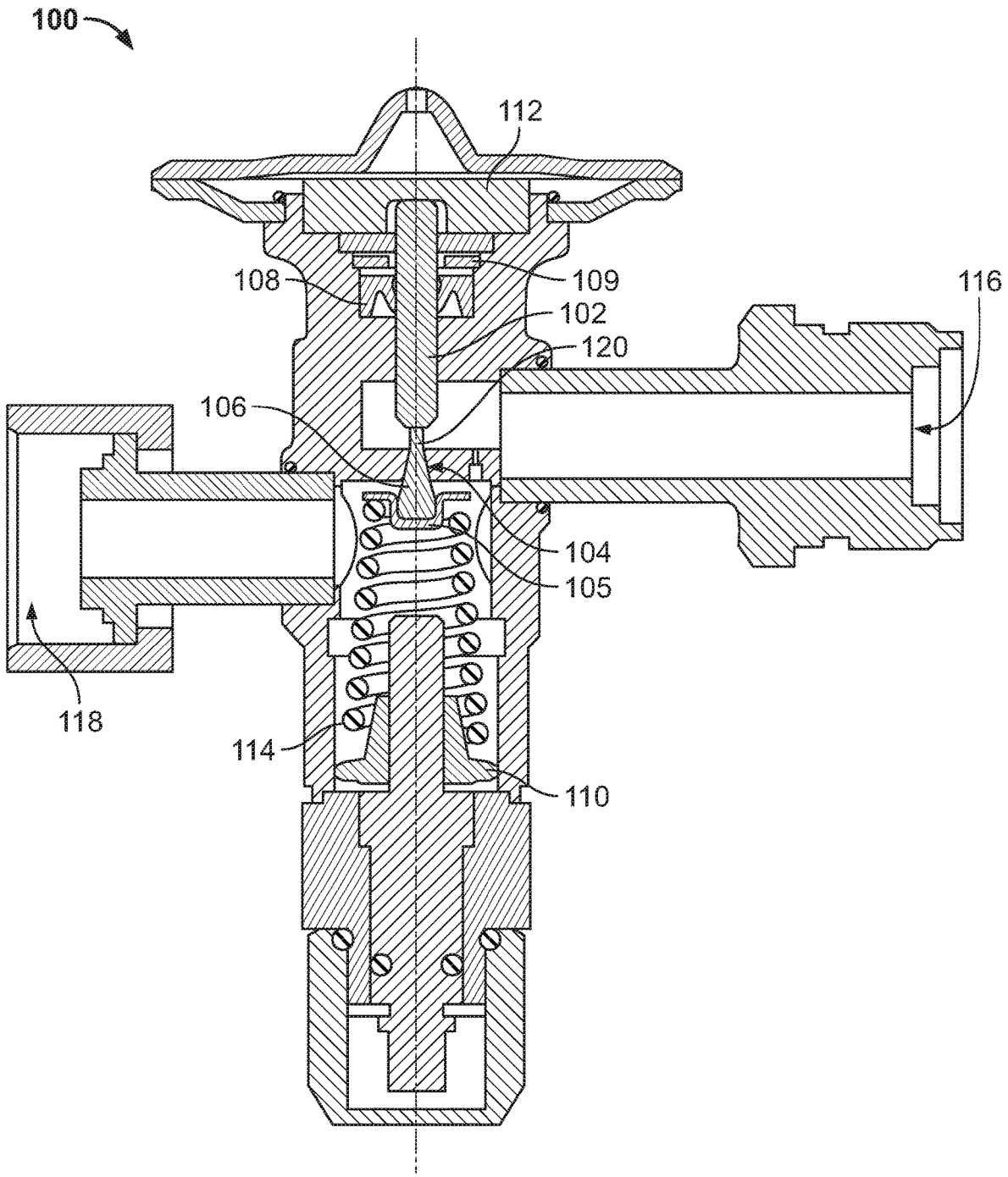
FIG. 1 is a cross-sectional view of a thermostatic expansion valve according to an example embodiment of the present disclosure.

Example embodiments will now be described more fully with reference to the accompanying drawings.

The refrigeration market is increasing demand for fractional tonnage expansion valves with balanced port construction. Current expansion valves do not offer a range of fractional tonnages with balanced port design. Some example embodiments disclosed herein utilize interchangeable valve elements to provide a range of fractional tonnage expansion valves with balanced port construction, while reducing the number of unique components for each fractional tonnage.

Multiple metering pins (e.g., a ⅐ ton metering pin, a ⅕ ton metering pin, a ¼ ton metering pin, a ⅓ ton metering pin, a ½ ton metering pin, etc.), may be interchangeable to provide different fractional refrigeration tonnages using the same thermostatic expansion valve. For example, the different pins may have the same base diameter and overall length with a different taper portion on each pin (e.g., a different degree of taper, a different location of the start of the taper along the pin, etc.). Accordingly, fractional refrigeration tonnages of the thermostatic expansion valve may be changed during manufacturing and assembly at a factory, by a technician in the field, etc., simply by replacing only the appropriate metering pin without replacing other components of the valve, etc.

In some embodiments, each interchangeable metering pin may facilitate a balanced port for the thermostatic expansion valve (e.g., due to the taper portion or "shoulder" design of each metering pin, etc.). For example, the normal projected area for each pin may be designed to equal an exposed area of the operating rod that the pin contacts at the tapered end. This may cancel out the forces due to pressure and facilitate balancing of the throttling port.

Thermostatic expansion valves are commonly used for controlling the flow of liquid refrigerant into an evaporator, and are often designed to regulate refrigerant liquid flow into the evaporator in approximate proportion to evaporation of refrigerant liquid in the evaporator. Refrigerant gas leaving the evaporator is regulated by the thermostatic expansion valve responding to the temperature of the refrigerant gas leaving the evaporator and the pressure in the evaporator. This controlled flow inhibits the return of refrigerant liquid to the compressor, and the thermostatic expansion valve may control the flow of refrigerant by maintaining a predetermined superheat.

An orifice in the thermostatic expansion valve meters the flow into the evaporator. The flow is modulated by a metering pin that varies the orifice opening. The metering pin may be subject to multiple forces, such as a power element pressure, an evaporator pressure, a superheat spring equivalent pressure, etc. For example, a power assembly pressure corresponding to a saturation pressure of the refrigerant gas temperature leaving the evaporator may move the metering pin in an opening direction, while dosing forces are supplied by an evaporator pressure and a superheat spring.

A vapor may be superheated whenever its temperature is higher than the saturation temperature corresponding to its pressure. The superheat equals the temperature increase above the saturation pressure at that temperature. The thermostatic expansion valve may control the superheat of the suction gas leaving the evaporator.

In conventional thermostatic expansion valves, the operating superheat of the thermostatic expansion valve may vary as the pressure drop across the thermostatic expansion valve ports changes due to changes in head pressure or suction pressure. Depending on the operating conditions under which the superheat was originally set, the imbalance can sometimes result in compressor flooding or evaporation starvation. A balanced port attempts to reduce the effect of the pressure imbalance, to permit the thermostatic expansion valve to operate at a fairly constant superheat over a wide range of operating conditions.

Some thermostatic expansion valves use a double ported design in which there are two paths for refrigerant flow. One path creates a force that tends to push the metering pin in the open direction, while the other path creates a force pushing the pin in the closed position. These paths are designed with the forces in each path equal to one another, to provide a balanced design.

In some embodiments, a metering pin includes a shoulder on the inlet side of the thermostatic expansion valve. The high inlet pressure times the area of the shoulder may result in an upward closing force, while the pressure differential across the pin results in a downward force. By designing the shoulder carefully, the downward force may be balanced.

Referring now to the Figures, FIG. 1 illustrates a thermostatic expansion valve 100 including an operating rod 102, a recessed receiver portion 104, and a first metering pin 106. The first metering pin 106 is positioned at least partially within the recessed receiver portion 104 to selectively contact the operating rod 102.

Figure 2B:
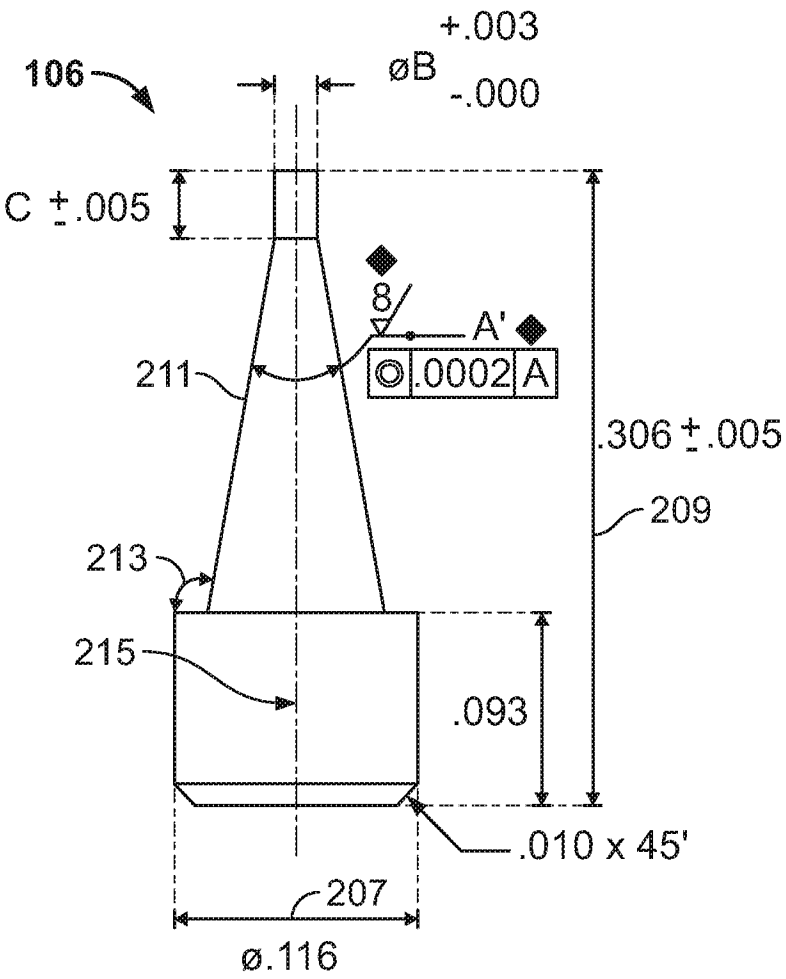
FIG. 2B is a side view of the metering pin of the thermostatic expansion valve illustrated in FIG. 1.
Figure 2A:
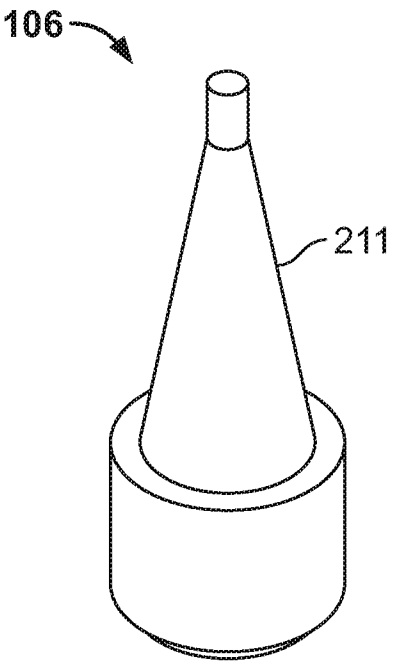
FIG. 2A is an orthogonal view of the metering pin of the thermostatic expansion valve illustrated in FIG. 1.

As shown in FIGS. 2A and 2B, the first metering pin 106 includes a base diameter 207, an overall length 209, and a taper portion 211. The taper portion 211 is tapered at a specified degree 213 relative to a longitudinal axis 215 of the first metering pin 106. FIG. 2B includes example dimensions for purposes of illustration only, and other embodiments may include any suitable dimensions for the metering pin 106.

The thermostatic expansion valve 100 is adapted to operate at a first specified refrigeration tonnage when the first metering pin 106 is positioned at least partially within the receiver portion 104, and to operate at a second specified refrigeration tonnage when the first metering pin 106 is replaced with a second metering pin including a different taper portion than the first metering pin 106.

Figure 3C:
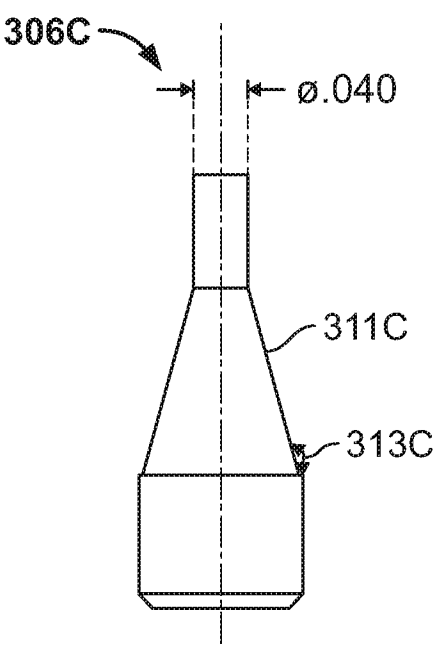
FIG. 3C is a side view of an example ½ ton metering pin for use in the thermostatic expansion valve illustrated in FIG. 1.
Figure 3B:
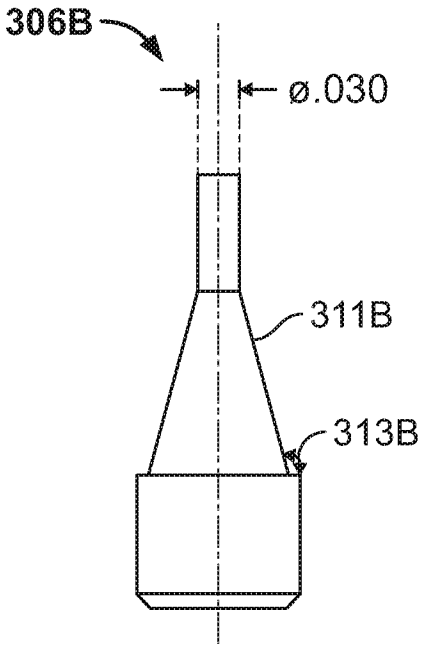
FIG. 3B is a side view of an example ¼ ton metering pin for use in the thermostatic expansion valve illustrated in FIG. 1.
Figure 3A:
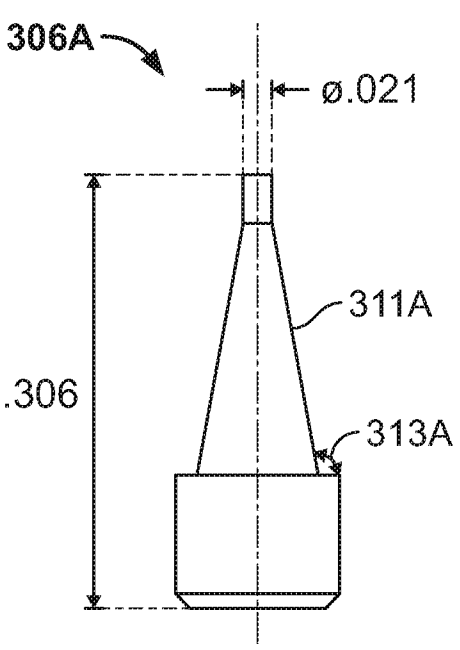
FIG. 3A is a side view of an example ⅕ ton metering pin for use in the thermostatic expansion valve illustrated in FIG. 1.

For example, FIGS. 3A-3C illustrate three different metering pins 306A, 306B, and 306C, each designed to operate the thermostatic expansion valve with a different specified refrigeration tonnage. FIG. 3A illustrates an example ⅕ ton metering pin 306A, FIG. 3B illustrates an example ¼ ton metering pin 306B, and FIG. 3C illustrates an example ½ ton metering pin 306C.

Each metering pin 306A, 306B and 306C includes a different taper portion 311A, 311B, and 311C, respectively. For example, the angle 313A, 313B, and 313C of each taper portion 311A, 311B, and 311C is different, and an upper starting point of the taper portion 311A, 311B, and 311C is different. FIGS. 3A-3C include example dimensions for purposes of illustration only, and other embodiments may include any suitable dimensions for the metering pins 306A, 306B and 306C.

Using the example metering pins 306A, 306B, and 306C, the thermostatic expansion valve 100 would be adapted to operate at a first specified refrigeration tonnage of ⅕ ton when the metering pin 306A is positioned at least partially within the receiver portion 104, to operate at a second specified refrigeration tonnage of ¼ ton when the metering pin 306A is replaced with the metering pin 306B, and to operate at a third specified refrigeration tonnage of ½ ton when the metering pin 306A or 306B is replaced with the metering pin 306C.

Although three different metering pins 306A, 306B, and 306C are disclosed herein, other embodiments may have more or less interchangeable metering pins, metering pins for other refrigeration tonnages, etc. For example, the valve 100 may be adapted to receive metering pins for operating at refrigeration tonnages of ⅐ ton, ⅓ ton, or any other suitable tonnage, which may depend on a type of refrigerant used with the valve 100.

In view of the above, the refrigeration tonnage operation of the thermostatic expansion valve 100 may be changed during manufacturing and assembly at a factory, by a technician in the field, etc., simply by changing only the metering pin 106, and leaving other components of the thermostatic expansion valve 100 in place.

For example, referring again to FIG. 1, the thermostatic expansion valve 100 includes a seal 108 (e.g., an internal seal, etc.), a washer 109, a spring carrier 110, a buffer plate 112, and a spring 114. The metering pin 106 may be replaced with another metering pin for a different refrigeration tonnage (or a different metering pin may be selected for the initial expansion valve assembly at a factory, etc.), without changing the operating rod 102, the seal 108, the washer 109, the spring carrier 110, the buffer plate 112, and the spring 114, etc. Therefore, the operating rod 102, the seal 108, the washer 109, the spring carrier 110, the buffer plate 112, the spring 114, etc., may be common among different metering pins 106 for different refrigeration tonnages.

Similarly, the recessed receiver portion 104 may be common among different metering pins 106. As shown in FIG. 1, the recessed receiver portion 104 may be a port that is chamfered, drilled, etc., to receive different metering pins 106.

FIG. 1 also illustrates an optional pin guide 105. As shown in FIG. 1, the pin guide 105 sits on top of the spring 114 and holds the metering pin 106 in place. In other embodiments, the pin guide 105 may be integral with the metering pin 106, so the metering pin 106 and the pin guide 106 have a one piece construction.

The thermostatic expansion valve 100 may include any suitable type of thermostatic expansion valve, such as a hermetic thermostatic expansion valve, etc. In some embodiments, the metering pin 106 may be adapted to facilitate operation of the thermostatic expansion valve 100 with at least one of a minimum tonnage of 1/10 Ton for R-290 system refrigerant, a minimum tonnage of 1/14 Ton for R-404A or R-1234yf system refrigerants, etc.

At least one of the operating rod 102, the recessed receiver portion 104, and the metering pin 106 may comprise stainless steel, or any other suitable material for controlling flow of refrigerant. In some embodiments, the thermostatic expansion valve 100 may include a check valve to inhibit refrigerant from flowing in a reverse direction through the thermostatic expansion valve 100.

As shown in FIG. 1, the thermostatic expansion valve includes an inlet port 116 for receiving refrigerant, and an outlet port 118 for supplying refrigerant. The metering pin 106 is located in a refrigerant flow path between the inlet port 116 and the outlet port 118.

Referring again to FIGS. 2A and 2B, the base diameter 207, overall length 209, and specified degree 213 of the taper portion relative to the longitudinal axis 215 of the metering pin 106 may facilitate a balanced port where an inlet pressure times an area of the taper portion 211 of the metering pin 106 results in an upward closing force on the valve that is balanced with a downward force according to a pressure differential across the metering pin 106.

For example, referring back to FIG. 1, a normal projection area of the metering pin 106 on the operating rod 102 at a tapered end 120 of the metering pin 106 may be equal to an exposed area of the operating rod 102 to balance the effects of inlet pressure on the thermostatic expansion valve 100.

For example if the pressure acts on a substantially similar exposed area of the operating rod 102 and normal projection area of the metering pin 106, the net force up or down on the operating rod 102 and metering pin 106 may be substantially balanced. In other words, an imbalance force that would otherwise bias the operating rod 102 and metering pin 106 may be reduced (e.g., eliminated), to provide better control over a wider range of evaporator loads.

The valve may be substantially balanced within a suitable tolerance range, which may include an upward closing force on the valve (e.g., an inlet pressure times an area of the taper portion 211 of the metering pin 106), is within about 1% of a downward opening force, within about 2% of the downward force, within about 5% of the downward force, etc.

The thermostatic expansion valve 100 may be used in any refrigeration system, such as a free-standing refrigerator, a milk cooler, a food service preparation table, a refrigerated drawer, an under-counter refrigerator, a walk-in refrigerator, a roll-in refrigerator, etc.

In some embodiments, the thermostatic expansion valve 100 may be used in a cooling system such as ice production equipment, ice storage equipment, a freezer, a storage cooler, a soft serve ice cream machine, a compressor, a condenser, an evaporator, a water filter, a slush and/or smoothie machine, a blast chiller, a blast freezer, a drop-in pan chiller, an ice cream cabinet, an air conditioner, a heat pump, etc.

According to an example embodiment of the present disclosure, a thermostatic expansion valve includes an operating rod, a recessed receiver portion, and a metering pin positioned at least partially within the recessed receiver portion to selectively contact the operating rod.

The metering pin includes a base diameter, an overall length, and a taper portion. The taper portion is tapered at a specified degree relative to a longitudinal axis of the metering pin. A normal projection area of the metering pin on the operating rod at a tapered end of the metering pin is equal to an exposed area of the operating rod to balance the effects of pressure on the thermostatic expansion valve.

The base diameter, overall length, and specified degree of the taper portion relative to the longitudinal axis of the metering pin may facilitate a balanced port where an inlet pressure times an area of the taper portion of the first metering pin results in an upward closing force on the valve that is balanced with a downward force according to a pressure differential across the metering pin.

According to an example embodiment of the present disclosure, a method of replacing a metering pin in a thermostatic expansion valve is disclosed. The thermostatic expansion valve includes an operating rod and a recessed receiver portion. The method includes inserting a first metering pin at least partially within the receiver portion to selectively contact the operating rod to operate the thermostatic expansion valve at a first specified refrigeration tonnage. The first metering pin includes a base diameter, an overall length, and a taper portion. The taper portion is tapered at a specified degree relative to a longitudinal axis of the first metering pin.

The method also includes removing the first metering pin from the receiver portion, and inserting a second metering pin at least partially within the receiver portion to selectively contact the operating rod to operate the thermostatic valve at a second specified refrigeration tonnage, wherein the second metering pin includes a different taper portion than the first metering pin.

The base diameter, overall length, and specified degree of the taper portion relative to the longitudinal axis of the first metering pin may facilitate a balanced port where an inlet pressure times an area of the taper portion of the first metering pin results in an upward closing force on the valve that is balanced with a downward force according to a pressure differential across the first metering pin.

Similarly, a base diameter, an overall length, and a specified degree of the taper portion relative to a longitudinal axis of the second metering pin may facilitate a balanced port where the inlet pressure times an area of the taper portion of the second metering pin results in the upward closing force on the valve that is balanced with the downward force according to the pressure differential across the second metering pin.

The thermostatic expansion valve may include at least one of a common seal, a common push rod, a common spring carrier, a common buffer plate, and a common spring. And, removing the first metering pin and inserting the second metering pin may include removing the first metering pin and inserting the second metering pin without changing the at least one of the common seal, the common spring carrier, the common buffer plate, and the common spring.

In some embodiments, the method further includes removing the second metering pin from the receiver portion, and inserting a third metering pin at least partially within the receiver portion to selectively contact the operating rod to operate the thermostatic valve at a third specified refrigeration tonnage, wherein the third metering pin includes a different taper portion than the first metering pin and the second metering pin.

For example, the first metering pin may be a ⅕ ton metering pin, the second metering pin comprises a ¼ ton metering pin, and the third metering pin comprises a ½ ton metering pin. Accordingly, fractional refrigeration tonnages of the thermostatic expansion valve may be selected, changed, etc., simply by inserting the appropriate metering pin, without replacing other components of the valve, while replacing only a minimal (or at least reduced) number of other components of the valve, etc. In some embodiments, each interchangeable metering pin may facilitate a balanced port for the thermostatic expansion valve (e.g., due to the taper portion or "shoulder" design of each metering pin, etc.).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. For example, when permissive phrases, such as "may comprise", "may include", and the like, are used herein, at least one embodiment comprises or includes such feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A thermostatic expansion valve comprising:

an operating rod;

a receiver portion;

a first metering pin positioned at least partially within the receiver portion to selectively contact the operating rod, the first metering pin including a base diameter, an overall length, and a taper portion, the taper portion tapered at a specified degree relative to a longitudinal axis of the first metering pin;

wherein the thermostatic expansion valve is adapted to operate at a first specified refrigeration tonnage when the first metering pin is positioned at least partially within the receiver portion, and to operate at a second specified refrigeration tonnage when the first metering pin is replaced with a second metering pin including a different taper portion than the first metering pin;

wherein:

the base diameter, overall length, and specified degree of the taper portion relative to the longitudinal axis of the first metering pin facilitate a balanced port where an inlet pressure times an area of the taper portion of the first metering pin results in an upward closing force that is balanced with a downward force according to a pressure differential across the first metering pin; and a base diameter, an overall length, and a specified degree of the taper portion relative to a longitudinal axis of the second metering pin facilitate a balanced port where the inlet pressure times an area of the taper portion of the second metering pin results in the upward closing force that is balanced with the downward force according to the pressure differential across the second metering pin.

2. The thermostatic expansion valve of claim 1, further comprising at least one of a common seal, a common push rod, a common spring carrier, a common buffer plate, and a common spring, wherein the first metering pin is replaceable by the second metering pin without changing said at least one of the common seal, the common spring carrier, the common buffer plate, and the common spring.

3. The thermostatic expansion valve of claim 1, wherein the first metering pin is adapted to facilitate operation of the thermostatic expansion valve with at least one of a minimum tonnage of 1/10 Ton for R-290 system refrigerant, and a minimum tonnage of 1/14 Ton for R-404A or R-1234yf system refrigerants.

4. The thermostatic expansion valve of claim 1, further comprising a check valve.

5. The thermostatic expansion valve of claim 1, wherein the thermostatic expansion valve comprises a hermetic thermostatic expansion valve.

6. The thermostatic expansion valve of claim 1, wherein at least one of the operating rod, the receiver portion, and the first metering pin comprises stainless steel.

7. The thermostatic expansion valve of claim 1, further comprising an inlet port for receiving refrigerant and an outlet port for supplying refrigerant, the metering pin located in a refrigerant flow path between the inlet port and the outlet port.

8. A refrigeration system including the thermostatic expansion valve of claim 1, wherein the refrigeration system comprises at least one of a free-standing refrigerator, a milk cooler, a food service preparation table, a refrigerated drawer, an under-counter refrigerator, a walk-in refrigerator, and a roll-in refrigerator.

9. A cooling system including the thermostatic expansion valve of claim 1, wherein the cooling system comprises at least one of ice production equipment, ice storage equipment, a freezer, a storage cooler, a soft serve ice cream machine, a compressor, a condenser, an evaporator, a water filter, a slush and/or smoothie machine, a blast chiller, a blast freezer, a drop-in pan chiller, an ice cream cabinet, an air conditioner, and a heat pump.

10. A thermostatic expansion valve comprising:

an operating rod;

a receiver portion;

a first metering pin positioned at least partially within the receiver portion to selectively contact the operating rod, the first metering pin including a base diameter, an overall length, and a taper portion, the taper portion tapered at a specified degree relative to a longitudinal axis of the first metering pin;

wherein the thermostatic expansion valve is adapted to operate at a first specified refrigeration tonnage when the first metering pin is positioned at least partially within the receiver portion, and to operate at a second specified refrigeration tonnage when the first metering pin is replaced with a second metering pin including a different taper portion than the first metering pin;

wherein the thermostatic expansion valve is adapted to operate at a third specified refrigeration tonnage when the first metering pin or the second metering pin is replaced with a third metering pin including a different taper portion than the first metering pin and the second metering pin.

11. The thermostatic expansion valve of claim 10, wherein:

the base diameter, overall length, and specified degree of the taper portion relative to the longitudinal axis of the first metering pin facilitate a balanced port where an inlet pressure times an area of the taper portion of the first metering pin results in an upward closing force that is balanced with a downward force according to a pressure differential across the first metering pin; and a base diameter, an overall length, and a specified degree of the taper portion relative to a longitudinal axis of the second metering pin facilitate a balanced port where the inlet pressure times an area of the taper portion of the second metering pin results in the upward closing force that is balanced with the downward force according to the pressure differential across the second metering pin.

12. The thermostatic expansion valve of claim 10, wherein:

the first metering pin comprises a 1/5 ton metering pin when the thermostatic expansion valve is operated with a specified refrigerant;

the second metering pin comprises a 1/4 ton metering pin when the thermostatic expansion valve is operated with the specified refrigerant; and the third metering pin comprises a 1/2 ton metering pin when the thermostatic expansion valve is operated with the specified refrigerant.

13. The thermostatic expansion valve of claim 10, further comprising at least one of a common seal, a common push rod, a common spring carrier, a common buffer plate, and a common spring, wherein the first metering pin is replaceable by the second or third metering pin without changing said at least one of the common seal, the common spring carrier, the common buffer plate, and the common spring.

14. The thermostatic expansion valve of claim 10, wherein a normal projection area of the first metering pin on the operating rod at a tapered end of the first metering pin is equal to an exposed area of the operating rod to balance the effects of pressure on the thermostatic expansion valve when the first metering pin is positioned at least partially within the receiver portion.

15. The thermostatic expansion valve of claim 14, wherein the base diameter, overall length, and specified degree of the taper portion relative to the longitudinal axis of the first metering pin facilitate a balanced port where an inlet pressure times an area of the taper portion of the first metering pin results in an upward closing force that is balanced with a downward force according to a pressure differential across the first metering pin.

16. A method of replacing a metering pin in a thermostatic expansion valve, the thermostatic expansion valve including an operating rod and a receiver portion, the method comprising:

inserting a first metering pin at least partially within the receiver portion to selectively contact the operating rod to operate the thermostatic expansion valve at a first specified refrigeration tonnage, the first metering pin including a base diameter, an overall length, and a taper portion, the taper portion tapered at a specified degree relative to a longitudinal axis of the first metering pin;

removing the first metering pin from the receiver portion; and inserting a second metering pin at least partially within the receiver portion to selectively contact the operating rod to operate the thermostatic valve at a second specified refrigeration tonnage, wherein the second metering pin includes a different taper portion than the first metering pin;

wherein:

the base diameter, overall length, and specified degree of the taper portion relative to the longitudinal axis of the first metering pin facilitate a balanced port where an inlet pressure times an area of the taper portion of the first metering pin results in an upward closing force that is balanced with a downward force according to a pressure differential across the first metering pin; and a base diameter, an overall length, and a specified degree of the taper portion relative to a longitudinal axis of the second metering pin facilitate a balanced port where the inlet pressure times an area of the taper portion of the second metering pin results in the upward closing force that is balanced with the downward force according to the pressure differential across the second metering pin.

17. The method of claim 16, wherein:

the thermostatic expansion valve further includes at least one of a common seal, a common push rod, a common spring carrier, a common buffer plate, and a common spring; and removing the first metering pin and inserting the second metering pin includes removing the first metering pin and inserting the second metering pin without changing said at least one of the common seal, the common spring carrier, the common buffer plate, and the common spring.

18. A method of replacing a metering pin in a thermostatic expansion valve, the thermostatic expansion valve including an operating rod and a receiver portion, the method comprising:

providing a first metering pin that is positionable at least partially within the receiver portion to selectively contact the operating rod to operate the thermostatic expansion valve at a first specified refrigeration tonnage, the first metering pin including a base diameter, an overall length, and a taper portion, the taper portion tapered at a specified degree relative to a longitudinal axis of the first metering pin;

providing a second metering pin that is positionable at least partially within the receiver portion to selectively contact the operating rod to operate the thermostatic valve at a second specified refrigeration tonnage when the first metering pin is replaced with the second metering pin, wherein the second metering pin includes a different taper portion than the first metering pin; and providing a third metering pin that is positionable at least partially within the receiver portion to selectively contact the operating rod to operate the thermostatic valve at a third specified refrigeration tonnage when the first metering pin or the second metering pin is replaced with the third metering pin, wherein the third metering pin includes a different taper portion than the first metering pin and the second metering pin.

19. The method of claim 18, wherein:

the base diameter, overall length, and specified degree of the taper portion relative to the longitudinal axis of the first metering pin facilitate a balanced port where an inlet pressure times an area of the taper portion of the first metering pin results in an upward closing force that is balanced with a downward force according to a pressure differential across the first metering pin; and a base diameter, an overall length, and a specified degree of the taper portion relative to a longitudinal axis of the second metering pin facilitate a balanced port where the inlet pressure times an area of the taper portion of the second metering pin results in the upward closing force that is balanced with the downward force according to the pressure differential across the second metering pin.

20. The method of claim 18, wherein the first metering pin, the second metering pin and the third metering pin are each adapted to operate at different refrigeration tonnages, and wherein:

the first metering pin comprises a first one of a ½ ton, ⅓ ton, ¼ ton, ⅕ ton and ⅐ ton metering pin, when the thermostatic expansion valve is operated with a specified refrigerant;

the second metering pin comprises a different second one of a ½ ton, ⅓ ton, ¼ ton, ⅕ ton and ⅐ ton metering pin, when the thermostatic expansion valve is operated with the specified refrigerant; and the third metering pin comprises a further different third one of a ½ ton, ⅓ ton, ¼ ton, ⅕ ton and ⅐ ton metering pin, when the thermostatic expansion valve is operated with the specified refrigerant.

* * * * *